US006230447B1

(12) United States Patent
Pribyl et al.

(10) Patent No.: US 6,230,447 B1
(45) Date of Patent: May 15, 2001

(54) LIFTING ANCHOR FOR PREFABRICATED CONCRETE PANELS

(76) Inventors: George E. Pribyl, 5730 Auto Club Cir., Bloomington, MN (US) 55437; Roger G. Kieley, 16920 25$^{th}$ Ave. North, Plymouth, MN (US) 55447

( * ) Notice: Subject to any disclaimer, the term of this patent is extended or adjusted under 35 U.S.C. 154(b) by 0 days.

(21) Appl. No.: 09/611,253

(22) Filed: Jul. 6, 2000

(51) Int. Cl.$^{7}$ ..... E02D 35/00

(52) U.S. Cl. ..... 52/125.2; 403/291; 403/305; 403/306

(58) Field of Search ..... 52/122.1, 707, 52/125.1, 125.6, 125.2, 125.3, 125.4, 125.5

(56) References Cited

U.S. PATENT DOCUMENTS

| | | | | |
|---|---|---|---|---|
| D. 272,517 | | 2/1984 | Koehn . | |
| 4,017,115 | | 4/1977 | Holt et al. . | |
| 4,077,599 | | 3/1978 | Oland . | |
| 4,437,272 | * | 3/1984 | Johnson | 52/64 |
| 4,615,554 | | 10/1986 | Schilla et al. . | |
| 4,842,240 | | 6/1989 | Pickett . | |
| 5,134,828 | | 8/1992 | Baur . | |
| 5,261,198 | | 11/1993 | McMillan . | |
| 5,649,782 | | 7/1997 | Frohlich et al. . | |

* cited by examiner

*Primary Examiner*—Carl D. Friedman
*Assistant Examiner*—Chi Nguyen

(57) ABSTRACT

A concrete lifting anchor having a pair of positioning elements at respective opposite ends of a steel rod, a threaded coupler extending from one end of the rod, and a tubular protector tightly fitted over the coupler, with a removable filler material inside the tubular protector.

9 Claims, 2 Drawing Sheets

LIFTING ANCHOR FOR PREFABRICATED CONCRETE PANELS

BACKGROUND OF THE INVENTION

The present invention relates to a lifting anchor for embedding into prefabricated concrete panels at the time of forming the panels; ie., at the time the concrete is poured into the panel mold. The invention is especially adapted for use in a prefabricated panel forming process where the concrete forming mold may be many hundreds of feet in length, and the mold is movable relative to a concrete pouring station. After curing, such prefabricated panels are typically cut into predetermined lengths to provide individual prefabricated panels for delivery to a job site. At the job site, each individual panel is then lifted to a vertical position, and aligned next to an adjacent vertically-positioned panel, to construct a concrete wall. The present invention provides an anchor to facilitate the lifting operation at the job site.

The continuous-mold practice of pouring a considerable length of concrete into a moving mold creates a requirement regarding the proper positioning of the lifting anchors which later will be used on the job site to lift each of the panel sections. The anchors are embedded into the concrete at the time of pouring and curing of the concrete, and each of the lifting anchors must be positioned adjacent a cut line so that the lifting anchor can be accessible, after the panel has been cut to the proper length, to be connected to a lifting device.

At the time of pouring, specifications are available to set the length of each of the prefabricated panels which ultimately are to be cut from the molded concrete sheet, and so the distances can be measured from one end of the concrete mold to place the anchors in the mold at predetermined spaced positions corresponding to the eventual lengths of each of the cut panels. However, overall system measurement tolerances may be cumulative, and therefore when literally dozens of measurements are made in an end-to-end fashion in an elongated concrete mold it is possible that the measured positions of the anchors in the mold may vary by as much as several inches from the specified positions in the final panel.

Later, when the elongated concrete sheet is cut into sections, it is imperative that the lifting anchors be exposed at the cut ends so that the panels can be properly raised. Two scenarios can be visualized: 1) the anchors are embedded into the concrete at too great a distance from the cut end, and therefore they cannot be accessed for lifting; or 2) the anchors are embedded into the concrete beyond the cut end position, and therefore the concrete-cutting saw not only cuts the concrete but also cuts the anchors and renders them useless.

The present invention provides a convenient solution to the above-described problems, and provides a novel construction for concrete anchors of the type described herein.

Reference may be made to U.S. Pat. No. 5,649,782, and U.S. Design Pat. No. D272,517 for examples of other and different types of panel lifting anchors. The design patent shows an eyelet structure affixed to two reinforcing bars which are embedded into the concrete at the time the prefabricated panels are formed, where the eyelet structure is protected from concrete immersion by some type of removable plug, and after the curing process the plug may be removed to provide access to the eyelet to provide a lifting anchor. The utility patent shows a female threaded member which is affixed to a reinforcing bar, and both members are embedded into the concrete at the time the prefabricated panels are formed; after curing, a threaded lifting loop may be inserted into the female member.

SUMMARY OF THE INVENTION

A lifting anchor for embedding into an elongated concrete sheet at the time of pouring and curing the concrete, the anchor having a forged head at one end for supporting the anchor in a mold, and having an elongate rod connected at one end to the forged head and connected at its other end to a support bracket which also supports the anchor in the mold; a threaded coupler affixed to the support bracket and elongate rod, and an elongate tube press-fit over the coupler, the tube having an internal filler which is readily removable from the tube to expose the threads in the coupler, thereby to connect to a panel lifting device.

DESCRIPTION OF THE PREFERRED EMBODIMENT

Figure 1:
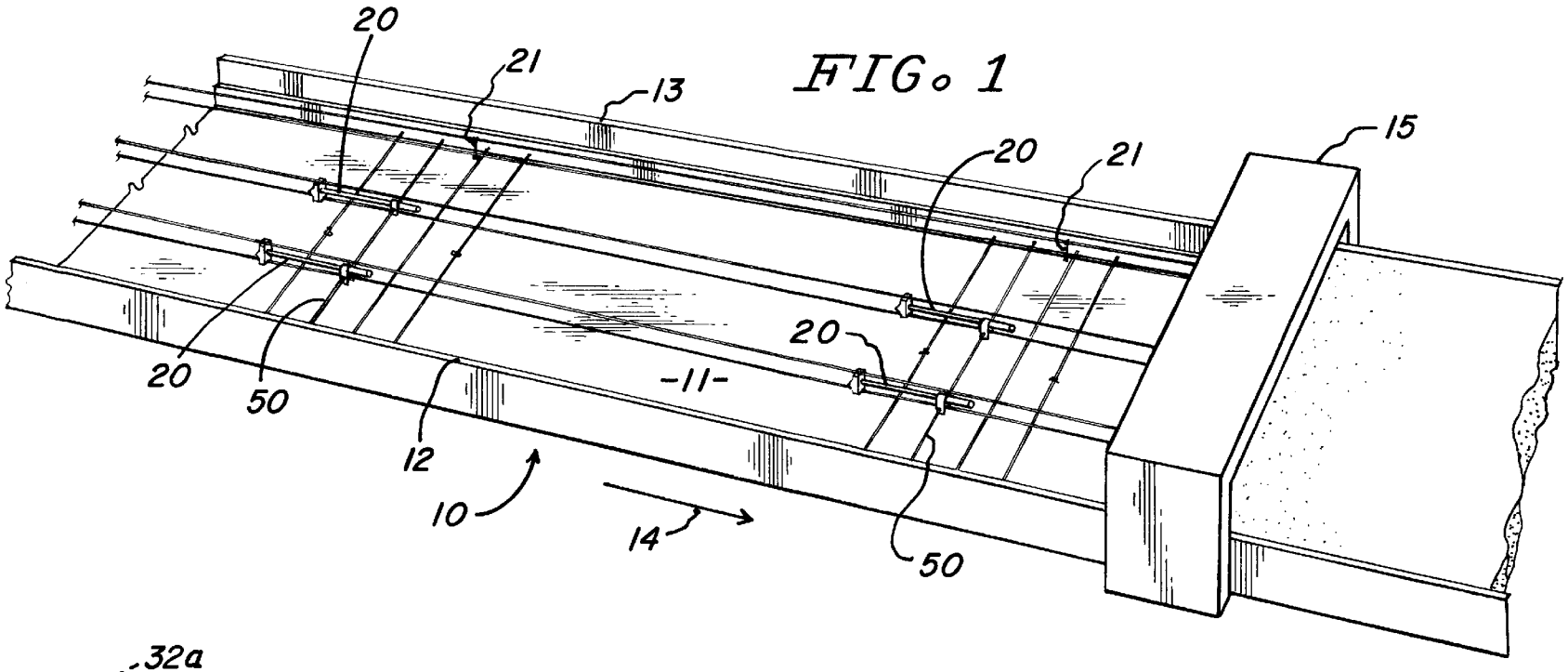
FIG. 1 shows an isometric view of a representative continuous concrete mold machine, with examples of lifting anchors positioned along the mold.

Referring first to FIG. 1, a representative continuous concrete mold machine 10 is shown diagrammatically. The machine comprises a mold base 11 and a pair of side walls 12, 13, all of which move in the direction shown by the arrow 14, eventually passing through a concrete pouring machine 15 which applies concrete into the mold as it passes. Prior to operating the mold machine, the machine undergoes a setup operation to place structural steel support members into the mold, to locate and position other braces and supports into the mold, and to place the concrete lifting anchors 20 into proper position for the eventual lifting of the concrete panels created by the process. In the example shown, four pairs of steel cables are held under tension at spaced apart locations across the mold, the cable pairs extending the entire length of the mold. Appropriate spacers 21 are used along the cable pair length to maintain a proper spacing between the two cables forming a pair, and each of the anchors 20 are also positioned between two cables in a pair. In positioning the anchors, measurements are made from one end of the mold and appropriate panel length marks are made directly on the base 11 for locating each pair of anchors. Since the mold may extend a distance of 500 feet or longer, it is apparent that some inaccuracies may occur in making the anchor position marks, and it is also apparent that such inaccuracies can lead to measurement tolerances which may be cumulative along the length of the mold. It is critically important that some provision be made for these tolerances, so that anchors which may be positioned as much as several inches from their desired locations can still be completely usable as lifting anchors after the panels are cut to length.

After the mold setup has been completed, concrete is applied into the mold for its entire length, and the mold is then allowed to sit until the concrete in the mold is cured and hardened. After curing, the sidewalls of the mold are lowered and the concrete sheet is passed by a cutting station where the individual panel sections are cut, by sawing through the concrete, and at the same time cutting through the elongate tubes and filler material constituting parts of the respective lifting anchors. The individual panel sections are transported to a construction site and are lifted into vertical positions to create a wall structure. This lifting operation requires use of the lifting anchors which were installed during the mold setup operation.

Figure 2:
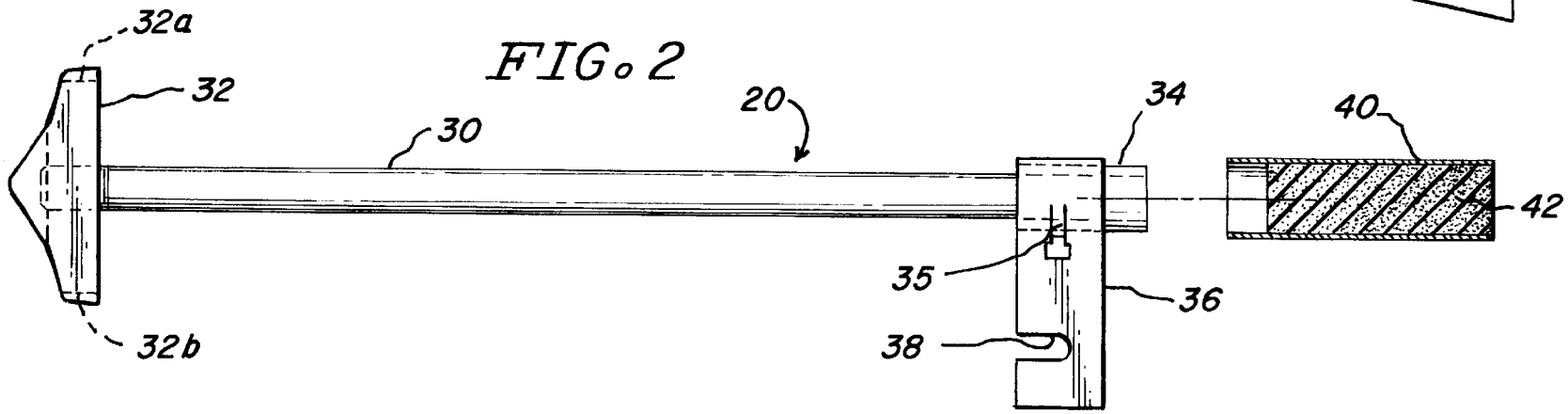
FIG. 2 shows a side elevation view of the invention.

FIG. 2 shows an elevation view of a single lifting anchor 20. A steel rod 30 preferably has two threaded ends; one end is threaded into a forged head 32 and the other end is threaded into a threaded coupler 34, where the rod thread length is such that the rod projects only about one-half way through the coupler 34. The rest of the coupler 34 length is threaded to accept a lifting device as will be hereinafter described. Coupler 34 is affixed to a support bracket 36, which preferably is formed from a U-shaped steel strap material. A pair of tabs 35 are formed in the walls of the support bracket 36, and these tabs are formed inwardly toward the coupler 34 and are welded to the coupler 34 to form a tight fit. The support bracket 36 also has a notch 38 in each of its legs for the purpose of attaching to a horizontal steel reinforcing rod which may be laid across the mold proximate the marked position for the anchor.

A tubular protector 40 is fitted over the protruding end of coupler 34, and the interior of protector 40 is filled with a removable filler material 42. In the preferred embodiment the protector 40 is constructed from plastic tubular material which may be press-fit over the coupler 34, and the filler material 42 is a resilient foam material which may be readily seen for removal at the construction site. Other materials may also be used for the protector 40 and the filler material 42, the important features being that the protector covers the coupler 34 and can be easily cut by the concrete cutting saw and the filler material provides protection for the interior coupler 34 threads during the molding process, but is readily removable at the construction site.

Figure 3:
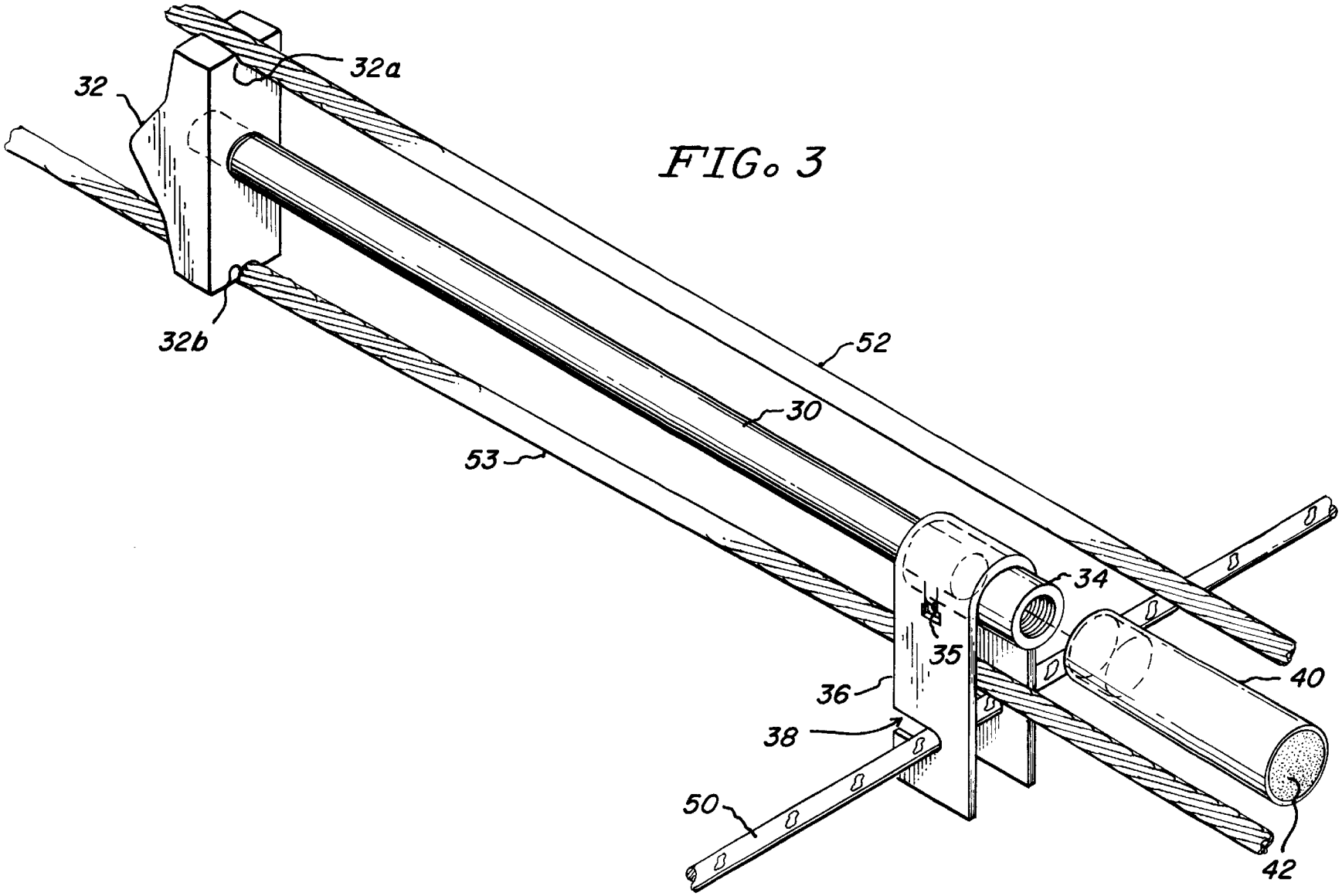
FIG. 3 shows an isometric view of the invention in an installed position relative to cables also embedded into the concrete sheet.

FIG. 3 shows an isometric view of the lifting anchor 20 in a proper mounting position in the mold form. The bottom edges are seated on the base 11 so as to position the rod 30 and coupler 34 at approximately one-half the thickness of the mold form. A horizontal reinforcing rod 50 may be inserted through the notch 38 to help position the support bracket 36. The coupler 34 is affixed inside the support bracket 36 as shown, with the tabs 35 formed inwardly and welded to the coupler 34. One end of rod 30 is threaded into coupler 34, and the other end of rod 30 is threaded into head 32. Head 32 has two grooves 32*a*, 32*b* sized to accept and seat the tensioned cables 52, 53, and cable 53 passes between the U-shaped legs of support bracket 36. The tubular protector 40 is tightly fitted over coupler 34, with the filler material 42 inside the tubular protector 40.

The operation of setting up and positioning the lifting anchor 20 has been previously described. The length of protector 40 may be varied so as to allow for measurement errors or varied production requirements in positioning the lifting anchor, while still providing for positioning the protector 40 within the range of a cutting saw at the time the concrete sheet is cut into panels. For example, if the range of measurement variation is plus or minus several inches, the length of protector 40 is selected to allow for this tolerance and still be in a position where it will be cut by the cutting saw, leaving at least some length of protector attached to coupler 34 after the cutting operation. At the construction site, the filler material 42 is removed from the interior of the protector 40 and a suitable lifting device is threaded into the threads of coupler 34 so as to permit a secure attachment to the lifting anchor 20 for purposes of lifting the concrete panel.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. A concrete lifting anchor comprising a steel rod having a first and second positioning element affixed at respective ends; said first positioning element further comprising a support bracket having a coupler with internal threads affixed thereto; a tubular protector fitted over said coupler and projecting away from said coupler, said tubular protector having a removable filler material contained inside the tubular protector; said second positioning element further comprising a head.

2. The apparatus of claim 1, wherein said support bracket further comprises a U-shaped member, and said coupler is affixed in the trough of said U-shape.

3. The apparatus of claim 2, wherein said support bracket further comprises a pair of aligned notches in respective legs of said U-shape, said notches being sized to accept a reinforcing rod.

4. The apparatus of claim 3, wherein said support bracket further comprises a tabular cutout in each of said legs, said tabular cutout being inwardly formed and secured to said coupler.

5. The apparatus of claim 1, wherein said head further comprises an internally threaded forging.

6. The apparatus of claim 1, wherein said tubular protector further comprises a tube made from plastic.

7. A concrete lifting anchor comprising a steel rod affixed between a forged head and a support bracket; a threaded coupler projecting from one end of said steel rod and beyond said support bracket; a tubular protector fitted over said coupler; and a filler material removably placed inside said tubular protector.

8. The apparatus of claim 7, wherein said support bracket further comprises a U-shaped member affixed about said coupler, said U-shaped member having respective notches in each of its legs for locating a reinforcing bar.

9. The apparatus of claim 8, wherein said steel rod further comprises a pair of threaded ends, one end threadably attached to said threaded coupler and the other end threadably attached to said forged head.

* * * * *